US005593246A

United States Patent [19]

Hedblom et al.

[11] Patent Number: 5,593,246

[45] Date of Patent: Jan. 14, 1997

[54] PATTERNED CHALK-RESISTANT PAVEMENT MARKING AND METHOD OF MAKING

[75] Inventors: Thomas P. Hedblom, Eagan, Minn.; Kathleen A. Hachey, Hudson, Wis.; Robert L. Keech, White Bear Lake, Minn.

[73] Assignee: Minnesota Mining and Manufacturing Company, St. Paul, Minn.

[21] Appl. No.: 296,677

[22] Filed: Aug. 26, 1994

[51] Int. Cl.[6] ..... E01F 9/00

[52] U.S. Cl. ..... 404/9; 404/14; 404/20; 428/172

[58] Field of Search ..... 404/9, 12, 14, 404/20; 428/143, 167, 168, 149, 172; 427/137, 412.1

[56] References Cited

U.S. PATENT DOCUMENTS

| | | | |
|---|---|---|---|
| 3,436,359 | 4/1969 | Hubin et al. | 260/2 |
| 3,580,887 | 5/1971 | Hubin | 260/47 |
| 4,117,192 | 9/1978 | Jorgensen | 428/337 |
| 4,248,932 | 2/1981 | Tung et al. | 428/325 |
| 4,282,281 | 8/1981 | Ethen | 428/149 |
| 4,381,388 | 4/1983 | Naples | 528/59 |
| 4,388,359 | 6/1983 | Ethen et al. | 428/143 |
| 4,490,432 | 12/1984 | Jordan | 428/220 |
| 4,530,859 | 7/1985 | Grunzinger, Jr. | 427/385.5 |
| 4,564,556 | 1/1986 | Lange | 428/325 |
| 4,758,469 | 7/1988 | Lange | 428/325 |
| 4,870,142 | 9/1989 | Czerwinski et al. | 525/528 |
| 4,937,127 | 6/1990 | Haenggi et al. | 428/148 |
| 4,969,713 | 11/1990 | Wyckoff | 350/109 |
| 4,988,541 | 1/1991 | Hedblom | 427/163 |
| 4,988,555 | 1/1991 | Hedblom | 428/172 |
| 5,053,253 | 10/1991 | Haenggi et al. | 427/204 |
| 5,087,148 | 2/1992 | Wyckoff | 404/12 |
| 5,094,902 | 3/1992 | Haenggi et al. | 428/150 |
| 5,124,178 | 6/1992 | Haenggi et al. | 427/204 |
| 5,227,221 | 7/1993 | Hedblom | 428/172 |
| 5,286,682 | 2/1994 | Jacobs et al. | 501/34 |

FOREIGN PATENT DOCUMENTS

| | | |
|---|---|---|
| 0037211A1 | 10/1981 | European Pat. Off. . |
| 0206670A3 | 12/1986 | European Pat. Off. . |

OTHER PUBLICATIONS

Kirk–Othmer, Encyl. Chem. Tech., pp. 615–627, v. 23, (3d. Ed. 1983).

*Primary Examiner*—Henry A. Bennett
*Assistant Examiner*—Pamela A. O'Connor
*Attorney, Agent, or Firm*—Gary L. Griswold; Walter N. Kirn; Karl G. Hanson

[57] ABSTRACT

A pavement marking 10 includes a base sheet 12, a barrier layer 30, a layer 32 of bonding material, a multitude of optical elements 34, and skid-resistant particles 36. The base sheet 12 contains rubber and fillers and has a number of protuberances 14 projecting from its front side 28. Valleys 16 are disposed between the protuberances 14. The barrier layer 30 is disposed on the front side 28 at least in valleys 16 and preferably over protuberances 14. The layer 32 of bonding material is disposed predominantly on protuberances 14 and in this position secures the optical elements 34 and skid-resistant particles 36 to the protuberances 14 but not to the valleys 16. The coverage of the front side 28 of base sheet 12 with barrier layer 30 and bonding material 32 prevents the fillers in the base sheet 12 from becoming present on the top surface of the pavement marking 10 and thereby preserves the intended color of the marking 10.

27 Claims, 3 Drawing Sheets

PATTERNED CHALK-RESISTANT PAVEMENT MARKING AND METHOD OF MAKING

The present invention pertains to a pavement marking that has optical elements or skid-preventative particles secured selectively to protuberances on the pavement marking. The pavement marking is resistant to discolorization or chalking, which has been known to occur on the top surface of pavement markings after they have been exposed to the sun for long periods of time. The invention also pertains to a method of making a chalk-resistant pavement marking.

Pavement markings are used on roadways to display traffic lanes to motor vehicle drivers. Very often pavement markings are retroreflective so that motor vehicle drivers can vividly see the markings at nighttime. Retroreflective pavement markings have the ability to return a substantial portion of incident light in the direction from which the light originated. Light from motor vehicle headlamps is returned toward the oncoming vehicle to illuminate the boundaries of the traffic lanes for the motor vehicle driver. Pavement markings also are used on roadways to hide or cover preexisting pavement markings so that traffic can be temporarily diverted from its normal path, such as in a road construction zone. When used for such a purpose, the pavement markings are not retroreflective and are black in color to match the roadway surface.

In view of the important purpose served by pavement markings, investigators have continuously attempted to make various improvements to them. Indeed, the pavement marking art is replete with patented disclosures; see for example U.S. Pat. Nos.: 5,286,682, 5,227,221, 5,087,148, 4,988,555, 4,969,713, 4,490,432, 4,388,359, 4,988,541, 4,490,432, 4,388,359, and 4,117,192. Known retroreflective pavement markings typically include a rubber base sheet that contains pigments and fillers. Optical elements and/or skid-preventative particles are secured to a surface of the base sheet by being embedded therein or by being secured thereto by a bonding material. Pigments and fillers typically are dispersed throughout the base sheet. Pigments also have been placed in the bonding material.

When the pavement marking is retroreflective, it often has a raised pattern of protuberances on the upper surface of the base sheet to elevate the optical elements so that the pavement marking remains retroreflective under wet conditions; see, for example, U.S. Pat. Nos. 5,227,221, 5,087,148, 4,969,713, and 4,388,359. Light that is incident upon a retroreflective pavement marking becomes retroreflected in the following manner. First, the incident light passes through the optical elements to strike the pigments in the base sheet or in the bonding material. The pigments then scatter the incident light, and the optical elements redirect a portion of the scattered light back in the direction of the light source. The skid-preventative particles do not play a role in retroreflectivity; they are disposed on retroreflective and non-retroreflective pavement markings to improve dynamic friction between the marking and a vehicle tire. The fillers are employed in the rubber base sheet for a number of reasons, including reducing cost, improving durability, and providing conformability.

The pavement markings disclosed in U.S. Pat. Nos. 5,227,221, 4,988,555, and 4,988,541 (referred to collectively as "the Hedblom patents") represent an advance in the art by making very efficient use of the optical elements and/or skid-preventative particles. This is accomplished by using a patterned base sheet and selectively applying a bonding material to the protuberances so that the optical elements and/or skid-preventative particles are secured exclusively to the protuberances where they are most effective. The optical elements and/or skid-preventative particles are substantially absent from the valleys where they make little contribution to the retroreflective performance and skid-resistance of the pavement marking. By selectively securing the optical elements and skid-preventative particles to the protuberances, less optical elements and less skid-preventative particles can be employed without sacrificing retroreflective performance and skid resistance.

Although the pavement markings disclosed in the Hedblom patents demonstrate good retroreflectivity and good skid resistance, and make efficient use of the optical elements and skid-preventative particles, it has been found that the fillers in the rubber base sheet have become present on the base sheet's front surface after the pavement marking has been exposed to the sun for an extended period of time. When a substantial quantity of fillers are present on the front surface of the base sheet, the pavement marking displays a white or chalky color. The presence of the fillers on the base sheet becomes problematic when the pavement marking is intended to display a color other than white. When the pavement marking has a color distinct from white—for example, red, green, blue, or black—the pavement marking's intended color can become severely diluted by the presence of the fillers. This problem is exceptionally severe in climates where the pavement markings are subject to intense exposure to the sun. In southern locations of the United States of America, red pavement markings have turned a pinkish color after being exposed to the sun for a few months.

The present invention provides a new pavement marking and a new method of making a pavement marking, where the chalking problem is overcome and efficient use is made of the optical elements and skid-preventative particles. In brief summary, the pavement marking of the invention comprises: (a) a base sheet having first and second major surfaces, the first major surface having a plurality of protuberances located thereon, the protuberances being separated by valleys, and the base sheet being comprised of a rubber and fillers; (b) a barrier layer disposed on the first major surface of the base sheet at least in the valleys; (c) a layer of bonding material disposed selectively on the protuberances so as to be substantially absent from the valleys; and (d) a plurality of optical elements, skid-preventative particles, or a combination thereof, secured to the protuberances of the base sheet by the bonding material. The method of the invention comprises: (a) providing a base sheet that contains rubber and fillers, the base sheet having a first major surface that has protuberances disposed thereon which are separated by valleys; (b) forming a barrier layer at least on the valleys of the base sheet; (c) applying a bonding material selectively to the protuberances so as to be substantially absent from the valleys; and (d) embedding in the bonding material optical elements, skid-preventative particles, or a combination thereof.

The pavement marking of the invention differs from known patterned pavement markings in that a barrier layer is disposed on the first major surface of the base sheet at least in the valleys. In the known patterned pavement markings that made efficient use of the optical elements and skid-preventative particles, the fillers would become present on the surface of the base sheet in the valleys between the protuberances. In this invention, it is believed that the placement of a barrier layer in the valleys prevents the rubber base sheet from becoming oxidized from exposure to ultra-violet (UV) light and thereby keeps the fillers from becoming exposed in the valleys of the pavement marking. When disposed over the protuberances, the barrier layer can preclude fillers from becoming present there too. The bonding-material it is believed, also protects the base sheet from oxidation to preclude fillers from becoming present on the protuberances. Pavement markings of the invention are able to display their intended color after being exposed to the sun for extended periods of time and therefore are very advantageous for use in climates where exposure to the sun is intense, particularly when a color other than white is intended to be displayed by the pavement marking.

This and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

The figures are idealized and are not drawn to scale.

DETAILED DESCRIPTION OF THE PREFERRED EMBODIMENTS

Figure 1:
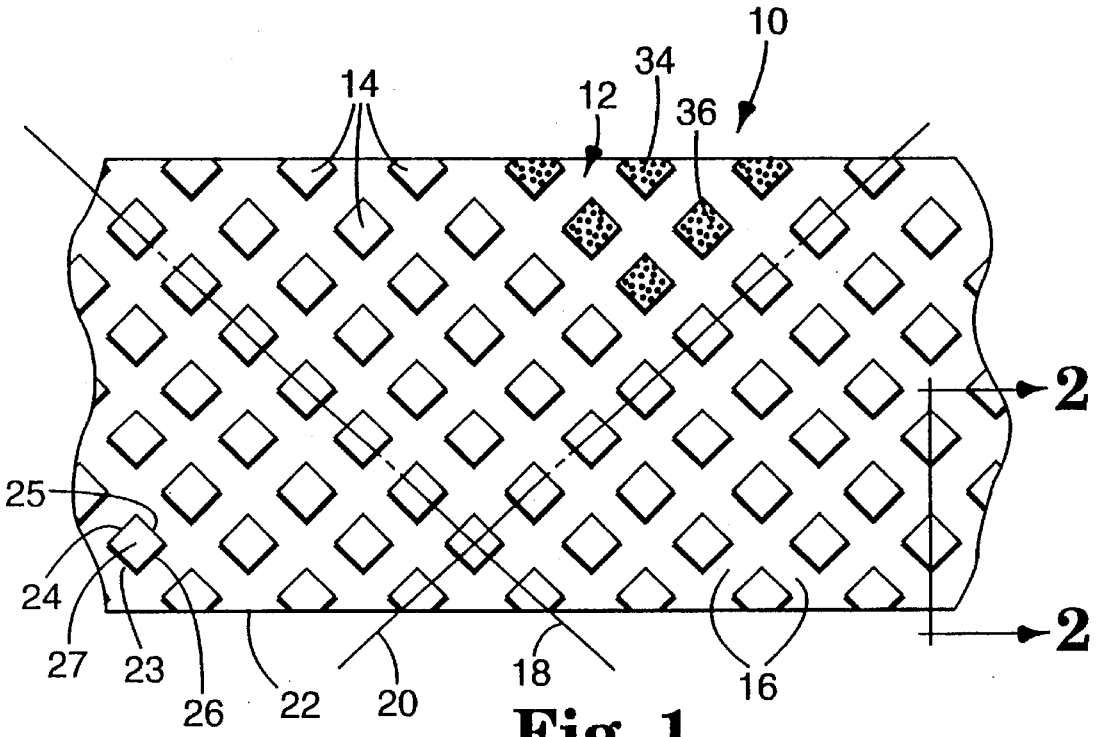
FIG. 1 illustrates a top view of a pavement marking 10 in accordance with the present invention.

In the practice of the present invention, a pavement marking is provided that makes efficient use of optical elements and/or skid-preventative particles and retains the desired color of the pavement marking after extended exposure to UV light. With reference to FIG. 1, a retroreflective pavement marking 10 of the invention includes a base sheet 12 that has a multitude of protuberances 14 located thereon. Valleys 16 separate adjacent protuberances 14 and provide an area for water to reside in the event rain falls on the pavement marking. The protuberances 14, which are elevated above the valleys, allow light transmission to and from the pavement marking to occur without being impaired by the presence of water. As illustrated, the protuberances 14 preferably are disposed on the base sheet 12 in rows 18 and columns 20, each oriented at about 45° to an edge 22 of the base sheet 12. The protuberances 14 generally have a square outline defined by four side surfaces 23, 24, 25, and 26, that meet at a top surface 27. The length of each side surface 23–26, typically is about 4 to 10 millimeters (mm), more typically about 6 mm. The rows 18 and columns 20 are spaced apart, typically, at a distance of about 2 to 10 mm, more typically at a distance of about 3 mm. As shown, the protuberances preferably are formed as an integral part of the base of the base sheet; that is, as one single unit and not two separate parts subsequently joined together.

Figure 2:
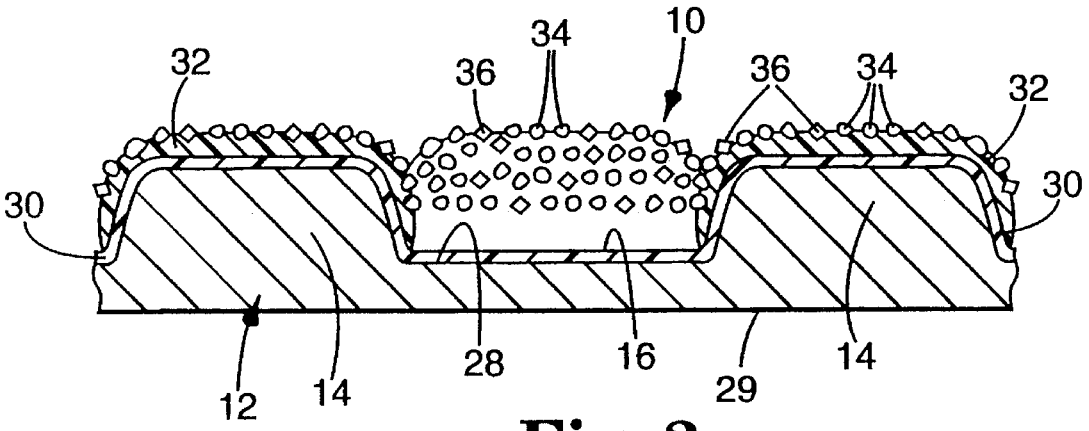
FIG. 2 illustrates a cross-section of pavement marking 10 in accordance with the present invention taken along lines 2—2 of FIG. 1.

FIG. 2 illustrates in cross-section a portion of a retroreflective pavement marking 10. As shown, pavement marking 10 includes a base sheet 2 that has protuberances 14 protruding from a first major surface or front side 28 of the base sheet 12. A second major surface 29 is disposed opposite the first major surface 28 and would be juxtaposed against a roadway surface when the pavement marking is placed in service. Located between adjacent protuberances 14 is a valley 16 also disposed on the front side 28 of base sheet 12. A barrier layer 30 is disposed at least in the valley 16 but as shown, preferably, also is disposed over the protuberances 14 to form a substantially continuous layer on the front side 28 of base sheet 12. A layer 32 of bonding material is disposed selectively over the protuberances 14 so as to be substantially absent from the valleys 16. A plurality of optical elements 34 and skid-resistant particles 36 are secured to the base sheet 12 by the layer 32 of bonding material. Because bonding material 32 is substantially absent from the valleys 16, the optical elements 34 and skid-resistant particles 36 are efficiently employed on the protuberances 14 where they are most effective. That is, the optical elements 34 and skid-resistant particles 36 are substantially absent from the valleys 16 where they serve little useful purpose.

A suitable base sheet for this invention may be formed using known methods and materials, such as described in U.S. Pat. Nos. 4,388,359 and 4,490,432 incorporated herein by reference. The embossed rubber base sheet may comprise elastomer precursors, not yet vulcanized or cured, which therefore permit viscoelastic deformation. Exemplary materials include acrylonitfile-butadiene polymers, millable urethane polymers and neoprenes. Examples of other rubber materials that may be employed in the base sheet include styrene-butadiene block copolymers, natural rubber, chlorobutadiene, polyacrylates, carboxyl-modified acrylonitfile-butadienes (see U.S. Pat. No. 4,282,281 incorporated here by reference). Extender resins—preferably halogenated polymers such as chlorinated paraffins, but also hydrocarbon resins or polystyrenes—preferably are included with the non-crosslinked elastomer precursor ingredients and are miscible with, or form a single phase with, the elastomer precursor ingredients. Thermoplastic reinforcing polymers preferably are dispersed in the elastomer precursor as a separate phase. Suitable thermoplastic reinforcing polymers include polyolefins, especially polyethylene, vinyl copolymers, polyethers, polyacrylates, polyurethanes, styrene-acrylonitrile copolymers and cellulose derivatives. In addition to the rubber component, the base sheet also includes fillers. As the term is used herein, "fillers" means an inert inorganic mineral material, typically in powder form, that is contained in the interior of the base sheet. The term "fillers" does not include pigments that provide colors other than white. The fillers may be included in the base sheet for a number of reasons, for example, to alter stiffness, to decrease cost, and to improve surface hardness and abrasion resistance. Examples of fillers that may be added to the base sheet include talc, mica, white pigments such as $TiO_2$ (white pigments are designated in the *Colour Index* as pigment whites under the notation "P.W."), silicates, glass beads, calcium carbonate, carbon black, asbestos, barytes, blanc fixe, slate flour, soft clays, et cetera. Most common fillers are $TiO_2$, $SiO_2$, and talc. The fillers typically are added to the base sheet at about 50 to 80 percent by weight, more typically at about 60 to 75 percent by weight, based on the weight of the base sheet.

As indicated above, the invention is particularly suitable for pavement markings that display a daytime color other than white. Daytime color can be determined in accordance with ASTM E 1164-91, a standard daytime color test. To display a daytime color other than white, colored pigments can be added to the base sheet. For example, yellow, red, green, blue, or black pigments may be added to the base sheet. Pigments that impart colors other than white are referred to herein as "colored pigments". When yellow is the desired color, the colored pigments may include pigment yellow (P.Y.) 83, 109, 110, 120, 173, 183, 191 (see *Colour Index*). When red is the desired color, the colored pigments may include: pigment red (P.R.) 101 or P.R. 170, for example RT 170-D, RT 171-P, RT 172-D, and RT 173-P, Naphthanil™ reds available from Cookson Pigments, Newark, N.J. The appearance of reds can be adjusted by adding colored pigments such as pigment orange (P.O.) 36, for example, an azoic pigment, or a violet pigments such as pigment violet (P.V.) 19, for example a quinacridone pigment also available from Harwick Chemical Corp. When green is the desired color, the colored pigments may include: pigment green (P.G.) 36 or P.G. 7, for example, Palomar™ green G-5420 (a copper phthalocyanine pigment) available from Miles Inc., Pittsburgh, Pa., and Endurophthal™ green GT-829-D (a phthalocyanine pigment) available from Cookson Pigment. When blue is the desired color, the colored pigments may include: pigment blue (P.B.) 15 such as Palomar™ Blue B-4720, a chlorinated phthalocyanine pigment from Miles, or Endurophthal™ Blue, a phthalocyanine blue from Cookson Pigment. When black is the desired color, the colored pigments may include: carbon black such as NYsynblak™ 9010 from Copolymer Rubber and Chemical Corp., Baton Rouge, La. Combinations of the above pigments also may be used. Generally, the colored pigments are added to the base sheet at about 1 to 10 weight percent.

The base sheet typically has a total thickness of about 1 to 5 mm (more typically about 2 mm), with the protuberances having a height of about 0.5 to 3 mm (more typically about 1 mm).

The barrier layer is essentially any material suitable for preventing chalking of the base sheet. It is believed that chalking can be prevented in accordance with the invention by preventing the base sheet from becoming substantially oxidized by exposure to UV light. It is believed that when substantial oxidization occurs, chalking follows; that is, the fillers become noticeably present on the top surface of the base sheet, resulting in an alteration of the desired color of the pavement marking. The selected barrier layer material should strongly bond to the base sheet, should preferably allow the bonding material to bond to the barrier layer, and, of course, should prevent chalking of the base sheet and be resistant to environmental weathering. The barrier layer, generally, is about 50 to 150 micrometers (μm) thick.

In this invention, it has been discovered that a suitable barrier layer can be a layer of polyurethane, preferably an aliphatic polyurethane. A preferred polyurethane barrier layer can be formed by first reacting two equivalents of methylene bis (4-cyclohexyl isocyanate) ($H_{12}MDI$) with one equivalent of a polycaprolactone triol polymer (a 2-oxypanone polymer with 2-ethyl-2-(hydroxymethyl)-1,3 propanediol) of molecular weight about 540 and hydroxyl number about 310 using dibutyltindilaurate as a catalyst. The reaction can be carrier out in ethyl-3-ethoxy propionate. Nuodex™—believed to be an eight weight percent zinc 2-ethylhexanoate catalyst available from Huls America of New Jersey—may be added to the barrier layer mixture shortly before applying the layers to the base sheet. Inclusion of up to about 10 percent of 2,4 pentanedione in the preferred barrier layer mixture can extend the pot life of the mixture from about 1.5 hours to about 15 hours. Another polyurethane that may be suitable for use as a barrier layer can include a polyurethane obtained by reacting a polycaprolactone triol polymer with an aliphatic polyisocyanate resin such as hexamethylene diisocyanate (HDI), for example, Desmodur™ N-3200 from Miles. Examples of other materials that may be suitable for use as a barrier layer include: epoxies, preferably aliphatic epoxies such as hydrogenated bisphenol A epoxies and other aliphatic epoxies such as polyethylene glycol diglycidylether, combination polymers based on aliphatic epoxies and diols (any of the above-mentioned epoxies would normally be used with a crosslinker such as a multi-functional aliphatic amine, carboxylic acid, acid anhydride, mercaptan or polyol, but can undergo homopolymerization as well); acrylics such as sorbent coated solutions of common acrylic and methacylic monomers with or without vinyl monomers; a wide variety of weathering stable, liquid applied coatings systems including but not limited to acrylated and/or methacylated oligomers, urea-formaldehyde and melamine-formaldehyde based crosslinking systems, polyesters, and polyaziridine/carboxylic acid systems. Preferred barrier layer materials are thermosetting polymers. Some barrier layer materials may be somewhat effective as clear resins, but virtually all would benefit from the use of appropriate UV stabilizers and/or a pigmentation system.

UV stabilizers—such as UV absorbers, hindered amines, nickel chelates, hindered phenols, and aryl esters—can be added to the barrier layer. Examples of UV stabilizers are disclosed in Kirk-Othmer, Encyl. Chem. Tech., pp. 615–627, v. 23, (3d. Ed. 1983). Additionally, colored pigments can be added to the barrier layer mixture to further protect the underlying base sheet and to enhance the color of the pavement marking (that is, match the base sheet's color). The colored pigments can be added to a polyurethane barrier layer mixture in the form of a dispersion. Useful ranges of pigment dispersion which may be included are 10–30 parts per 25 parts of urethane prepolymer. The colored pigments, generally, are present in the barrier layer at 1 to 40 percent based on the weight of the barrier layer. Useful colored pigments may include those cited above for use in the base sheet, and any other colored pigments typically used for coloring pavement markings also may be used.

Suitable bonding materials for securing the optical elements to the base sheet may be thermoplastic or thermosetting polymeric binders. One such polymeric binder is a vinyl-based thermoplastic resin; see U.S. Pat. No. 4,117,192, incorporated herein by reference. Other suitable bonding materials include two-part polyurethanes formed by reacting polycaprolactone diols and triols with derivatives of hexamethylene diisocyanate; epoxy based resins as described in U.S. Pat. Nos. 4,248,932, 3,436,359, and 3,580,887; and blocked polyurethane compositions as described in U.S. Pat. No. 4,530,859. Also suitable as a bonding materials are polyurethane compositions comprised of a moisture activated curing agent and a polyisocyanate prepolymer. The moisture activated curing agent preferably is an oxazolidene ring. Such compositions are described in U.S. Pat. No. 4,381,388. A preferred bonding material is the polyurethane composition described above for use as the barrier layer. The layer of bonding material also may contain the UV stabilizers and colored pigments cited above. The bonding material can be colored to match the color of the base sheet and barrier layer. The UV stabilizers and colored pigments may be incorporated into the bonding material as taught in the Hedblom patents, the disclosures of which are incorporated here by reference.

Generally, suitable bonding materials, such as described above, are characterized by excellent adhesion to the optical elements and/or skid-preventative particles, which are embedded in the layer of bonding material. Additionally, the layer of bonding material preferably strongly adheres to the barrier layer and is highly cohesive and resistant to environmental weathering. Typically, the bonding material is present on the pavement marking at a dry thickness of about 70 to 500 μm.

Optical elements suitable for use in the invention include glass microspheres (also known as beads or retroreflective beads) formed of glass materials having indices of refraction of from about 1.5 to about 1.9. As is well known in the art, glass microspheres of material having an index of refraction of about 1.5 are less costly and more durable than glass microspheres of material having an index of refraction of from about 1.75 to about 1.9; however, the less expensive, durable glass microspheres can be less effective retroreflectors.

The microspheres preferably have a diameter compatible with the size, shape, spacing and geometry of the protuberances present on the base sheet. Typically, microspheres of from 50–350 μm in diameter may be suitably employed. Other factors affecting element size are the number of rows of beads desired to be available to vehicle headlights. See the Hedblom patents.

Preferred optical elements are disclosed in U.S. Pat. Nos. 4,564,556 and 4,758,469, which are incorporated here by reference and are generally described therein as solid, transparent, non-vitreous, ceramic spheroids comprising at least one crystalline phase containing of at least one metal oxide. The ceramic spheroids also may have an amorphous phase such as silica. The term non-vitreous means that the spheroids have not been derived from a melt or mixture of raw materials capable of being brought to a liquid state at high temperatures, like glass. The spheroids are resistant to scratching and chipping, are relatively hard (above 700 Knoop hardness), and are made to have a relatively high index of refraction (ranging between 1.4 and 2.6). These optical elements may comprise zirconia-alumina-silica and zirconia-silica.

The skid-preventative particles can be, for example, ceramics such as quartz or aluminum oxide or similar abrasive media. Preferred skid-preventative particles include fired ceramic spheroids having a high alumina content such as taught in U.S. Pat. Nos. 4,937,127, 5,053,253, 5,094,902, and 5,124,178 to Haenggi et al., incorporated here by reference. The particles are preferred because they do not shatter upon impact like crystalline abrasive media such as $Al_2O_3$ and quartz. Skid-preventative particles typically have sizes of about 300 to 800 micrometers.

Figure 3A:
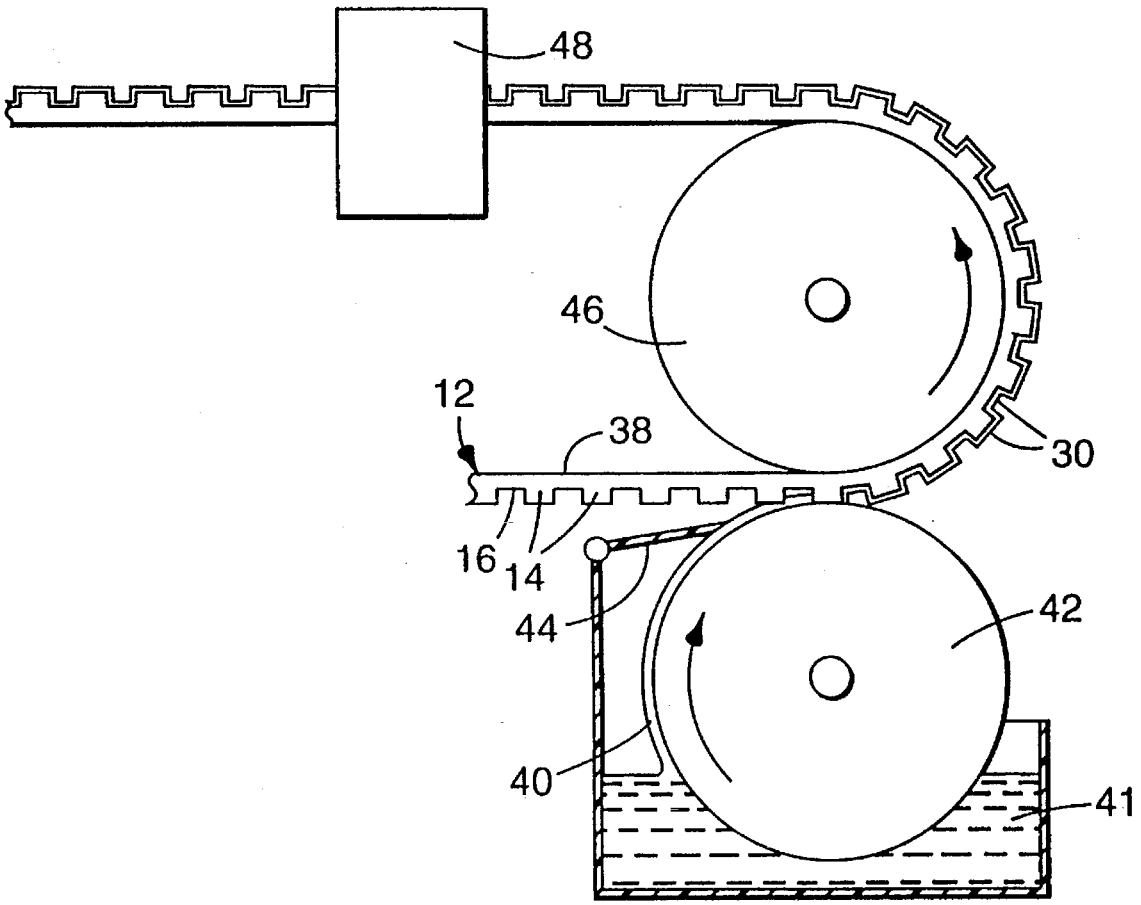
FIGS. 3*a* and 3*b* schematically illustrate a method of making a pavement marking 10 in accordance with the present invention.
Figure 3B:
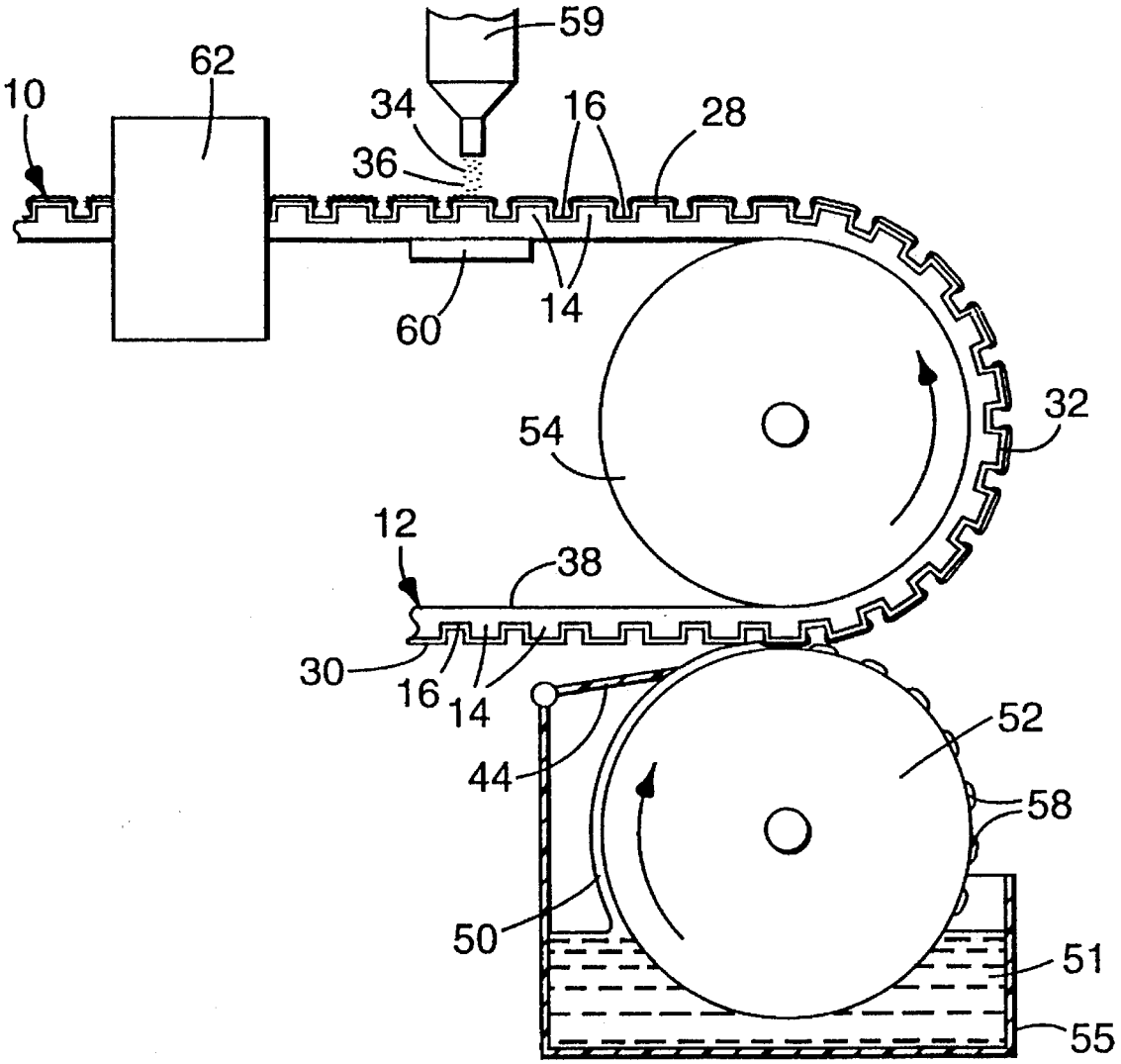

Retroreflective pavement markings of the invention can be made in accordance with the method illustrated in FIGS. 3*a* and 3*b*. The method can be carried out continuously by the sequential steps of: (1) providing a resilient base sheet that contains rubber and fillers and that has a plurality of protuberances and valleys located on a first side of the base sheet; (2) applying a barrier layer to the first side of the base sheet at least in the valleys and allowing the barrier layer to dry; (3) applying a layer of bonding material selectively to the protuberances after the barrier layer has dried; and (4) embedding optical elements and/or skid-preventative particles into the bonding material before it dries.

The base sheet can be provided in accordance with known procedures; see the Hedblom patents and U.S. Pat. Nos. 4,388,359 and 4,490,432.

The second step of the process involves applying the barrier layer 30 to the valleys 16 on the first side 28 of base sheet 12. Preferably the barrier layer 30 is applied as a continuous layer that covers the valleys 16 and substantially all of each protuberance 14. This can be readily accomplished through a squeeze roll coating process shown schematically in FIG. 3*a*. The base sheet material 12 is oriented with the protuberances 14 projecting downward and the back face 38 oriented upward. A film 40 of barrier liquid 41 is metered onto a soft metering roller 42 using a doctor blade or notch bar 44. The soft metering roller 42 preferentially is made of rubber having a Shore A hardness of 55 or less. The film 40 of barrier liquid 41 is squeezed onto the surface of the patterned base sheet 12 between the soft metering roller 42 and a hard backing roller 46. The backing roller 46 preferably is made of steel. Nip force per unit length of approximately 170 Newtons per lineal centimeter (N/cm) have been used to deposit the film 40 evenly throughout the valley areas. Alternatively, if sufficient pressure is exerted between the metering roller 42 and the backing roller 46, a doctor blade 44 is not required to meter the film 40 of barrier material 41 onto the base sheet 12. The nip pressure can be sufficient in and of itself to meter the required coating 30 of barrier liquid. After the barrier layer 30 has been applied to the base sheet 12, the coating 30 is cured or dried in an oven 48. The patterned based sheet 12 having the barrier layer 30 disposed thereon subsequently is passed to the apparatus illustrated in FIG. 3*b* to perform steps 3 and 4 of the method.

To carry out the third step of the method, the base sheet material 12 is oriented with the protuberances 14 projecting downward and the second major surface or back side 38 oriented upward. The protuberances 14 contact a film 50 of liquid bonding material 51 on a print roller 52. Print roller 52 receives the film 50 of bonding material 51 by being first immersed in a reservoir 55 of liquid bonding material 51. Print roller 52 preferably has a hard outer surface (e.g. of steel) to enable the liquid bonding material 51 to be selectively applied to the protuberances 14. A backing roller 54 contacts the back surface 38 of base sheet 12 to advance the latter by rotating counterclockwise in the direction of the arrow. As the base sheet 12 advances, print roller 52 passes through the reservoir 55 of liquid bonding material 51 to form the film 50 on the print roller 52. A doctor blade or notch bar 44 may be used to meter the film 50 to a desired thickness. As the rotation continues, the film 50 contacts the protuberances 14. As protuberances 14 contact film 50, a discontinuous layer 32 of bonding material is applied to or printed on protuberances 14. Non-adhering portions 58 of film 50 return to the reservoir 55 on the print roller 52.

Several factors affect transfer of liquid barrier layer material 40 and bonding material 51 onto base sheet 12. These factors may include nip pressure, hardness of print roller 52, hardness of backing rollers 46 and 54, softness of metering roller 42, viscosity of barrier layer material 40, viscosity of bonding material 51, speed of base sheet 12, and speed of rotation of backing rollers 46, 54 relative to metering roller 42 or print roller 52. These variables may be adjusted as desired and are discussed at length in the Hedblom patents.

In carrying out the fourth step of the method, the base sheet 12 is inverted after the layer 32 of bonding material has been applied to the protuberances 14. Optical elements 34 and skid-resistant particles 36 then are applied to the base sheet 12 and become partially embedded in the still fluid layer 32 of bonding material. The optical elements 34 and skid-resistant particles 36 may be applied by a flood coating process which results in a dense packing of the optical elements 34 on the front surface 28 of base sheet 12. This can be accomplished by dropping the optical elements 34 and skid-preventative particles from a hopper 59 onto the top surface 28 of base sheet 12. A vibrator 60 such as a rotating bar can be disposed beneath base sheet 12 to cause the optical elements which fall into the valleys to bounce up on the layer 32 of bonding material on the protuberances 14. Alternatively, the optical elements 34 may be sprinkled or cascaded upon the base sheet 12 such that a dense packing is avoided. The sprinkling process may be advantageous for decreasing optical element usage and for decreasing dirt retention between beads.

After the optical elements 34 are partially embedded in liquid bonding material, the bonding material is solidified to lock the optical elements in a secured position in the layer 32 of bonding material on the protuberances. An oven 62 may be useful for providing temperatures sufficient to cause solidification. Upon leaving the oven 62, a vacuum (not shown) can be employed to gather unsecured optical elements 34 and skid-preventative particles 36 for recycle.

The following Examples have been selected to illustrate features, advantages, and other details of the invention. It is to be expressly understood, however, that while the Examples serve this purpose, the particular ingredients and amounts used as well as other conditions and details are not to be construed in a manner that would unduly limit the scope of this invention.

EXAMPLES

Tests

In the examples set forth below, the following tests were used to evaluate the samples.

Samples were artificially weathered in a water cooled xenon are weatherometer. The samples were subjected to a repeating cycle of 102 minutes of light and 18 minutes of light plus a water spray. The light source was a 6500 watt xenon burner filtered by borosilicate inner and outer filters, with an irradiance of 0.35 watts per square meter. This test is described in ASTM G 26-93 "Standard Practice for Operating Light-Exposure Apparatus (Xenon-Arc Type) With and Without Water for Nonmetallic Materials." Test Method 1 was used in ASTM G 26-93, and the weathering apparatus was a Type B. Further reference to ASTM G 26-93 herein means ASTM G 26-93 using Test Method 1 and apparatus Type B.

Color measurements were made on a Spectro/plus™ colorimeter manufactured by Color and Appearance Technology, Inc. The measurements were made according to ASTM test method E 1349-90, "Standard Test Method for Reflectance Factor and Color by Spectrophotometry using Bidirectional Geometry". This test was followed with ASTM test method E 308-90, "Standard Test Method for Computing the Colors of Objects by using the CIE System", to calculate L*, a*, and b* color coordinates for the samples. The color coordinates L*, a*, b* may be determined in accordance with the procedure outlined in ASTM E 308-90, where the following operating parameters are set forth below:

Standard illuminant: D65 daylight illuminant

Standard observer: CIE (International Commission of Illumination)

1931 2°

Wavelength interval: 20 nanometers (nm)

Incident light: 0° on sample plane

Viewing: 45° through a ring of 16 fiber optic receptor stations

Area of view: 12 mm diameter circle

Port size: 16 mm diameter circle

Knowing these parameters, a person of ordinary skill can reproduce this test. "ASTM" E 308-90" is used herein to mean ASTM E 308-90, where the above-noted parameters are as provided above. For a further discussion of the operating parameters see ASTM E 1164-93. Color difference Delta E* was calculated between weathered and non-weathered examples according to ASTM test method D 2244-93, "Standard Test Method for Calculation of Color Differences from Instrumentally Measured Color Coordinates".

Base Sheet Formation

In the examples set forth below, the following materials were used to construct the samples.

To form a red base sheet material, the ingredients in Table 1 were mixed in an internal mixer until they reached an internal temperature of approximately 150° C. The material then was cooled on a rubber mill and was calandered into a sheet about 1.4 mm thick. The material was again heated to approximately 135 ° C. and was passed between an embossing roll and a smooth backup roll to produce a pattern similar to the pattern shown in FIG. 1. The protuberances were about 1 mm high, had side surfaces of equal length of about 6 mm, and were separated by valleys of about 3 mm.

TABLE 1

| Component | Parts |
|---|---|
| Acrylonitrile-butadiene non-crosslinked elastomer precursor (Paracril ™ B supplied by Uniroyal Chemical Company, Inc. Middlebury, Connecticut) | 100 |
| Talc platelet filler particles averaging 2 micrometers in size (Mistron Superfrost ™ supplied by Luzenac America, Inc., Englewood, Colorado) | 105 |
| 3 denier polyester filament ¼ inch long (Short Stuff ™ supplied by Mini Fibers, Inc., Johnson City, Tennessee) | 10 |
| Fibers of high-density polyethylene having a molecular weight ranging between 30,000 and 150,000 (Fybrel ™ supplied by Mini Fibers, Inc., Weber City, Virginia) | 20 |
| Phenol type anti-oxidant (Santo White ™ crystals supplied by Monsanto Co., Akron, Ohio) | 1 |
| Chlorinated paraffin (Chlorez ™ 700S supplied by Dover Chemical Corp., Dover, Ohio) | 70.0 |
| Spherical silica reinforcing filler (HiSil ™ 233 supplied by PPG Industries, Pittsburgh, Pennsylvania) | 27.5 |
| Stearic Acid processing aide | 1.0 |
| Chlorinated paraffin (Paroil ™ 140LV supplied by Dover Chemical Corp., Akron, Ohio) | 5.0 |
| Phosphite Chelator (Vanstay ™ SC supplied by R. T. Vanderbilt Co. Inc., of Norwalk, Connecticut) | 0.5 |
| Rutile titanium dioxide pigment (TiPure ™ R-960 supplied by E. I. dupont de Nemours, Wilmington, Delaware) | 5.0 |
| Monoazo Naphthol Pigment (Red Pigment RT-170D supplied by Cookson Pigment, Newark, New Jersey) | 6.65 |
| Monoazo Naphthol Pigment (Red Pigment RT-172D supplied by Cookson Pigment, Newark, New Jersey | 6.65 |
| Transparent glass microspheres ranging from 100–210 micrometers in diameter and having an index of refraction of 1.5 (Flexolite, Inc., St. Louis, Missouri) | 285.0 |
| TOTAL | 643.3 |

Urethane Prepolymer

A urethane prepolymer was manufactured by reacting two equivalents of methylene bis (4-cyclohexyl isocyanate) with one equivalent of a polycaprolactone triol (a 2-oxypanone polymer with 2-ethyl-2-(hydroxymethyl) 1,3-propanediol)

of molecular weight about 540 and hydroxyl number about 310 using dibutyltindilaurate as a catalyst. The reaction was carded out in ethyl-3-ethoxy propionate. After the reaction, the polymer was further diluted with 2,4 pentanedione to improve potlife stability. The final prepolymer solution contained approximately 50 percent by weight urethane prepolymer, and 10 percent by weight 2,4 pentanedione.

Example 1

A red barrier layer coating approximately 75 μm thick having the formulation set forth in Table 2 was applied to the red patterned base sheet using the method schematically shown in FIG. 3*a*. Approximately a 300 μm thick film of the formula set forth in Table 2 was metered using a notch bar. The lower rubber roll had a Shore A hardness of 55. The patterned base sheet was squeezed between the lower rubber roll and the upper steel backup roll. Nip force per unit length was 170 N/cm. The speeds of the rubber roll and the backup roll were matched at approximately 6 meters per minute. After coating the barrier layer, the coating was cured for approximately 10 minutes at about 150 ° C. The sample was placed in a weatherometer and was tested for color change after accelerated aging. The results of the tests are set forth in Table 4.

TABLE 2

| Component | Percent By Weight |
|---|---|
| Urethane prepolymer | 83 |
| Methyl isobutyl ketone | 2.95 |
| Nuodex ™ | 1.47 |
| Stantone ™ 10EPX03 (55% by weight $TiO_2$ in an epoxy carrier supplied by Harwick Chemical Corp., Akron, Ohio) | 2.25 |
| Stantone ™ 16911 (30% by weight red pigments in epoxy carrier supplied by Harwick Chemical Corp.) | 10.32 |

Example 2

A clear barrier layer coating approximately 65 μm thick having the formulation set forth in Table 3 was applied to the red patterned base sheet in the manner described in Example 1. After coating and solidifying the barrier layer, the sample was placed in a weatherometer and was tested for color change after accelerated aging. The results of the tests are set forth in Table 4.

TABLE 3

| Component | Percent By Weight |
|---|---|
| Urethane prepolymer | 90 |
| Methyl isobutyl ketone | 9 |
| Nuodex ™ | 1 |

Example 3 (Comparative)

This Comparative Example was the red patterned base sheet described above. A barrier layer was not applied to the top surface of the patterned base sheet. The red patterned base sheet was tested for color change after accelerated aging. The results of the tests are set forth in Table 4.

Example 4 (Comparative)

A red bonding material of the formulation shown in Table 2 was squeeze roll coated onto protuberances of the red base sheet. The bonding material was coated on the protuberances so as to be substantially absent from the valleys of the base sheet. The coating and bonding steps were carded out according to the method schematically illustrated in FIG. 3*b*. Approximately a 450 micrometer (μm) thick film of the formula set forth in Table 2 was metered onto the lower sheet roll using a notch bar. The patterned base sheet was passed through the gap between the upper and lower rolls. The gap distance between the upper and lower rolls was adjusted such as to press the bonding material onto the tops of the protuberances, and down the sides of the protuberances to the intersection with the valleys. After coating the bonding material onto the protuberances, ceramic microspheres were embedded therein, and the bonding material subsequently was cured. A barrier layer was absent from this material. The sample was placed in a weatherometer and was tested for color change after accelerated aging. The results of the tests are set forth in Table 4.

Example 5

A red barrier layer coating of the formulation set forth in Table 2 was applied to the valleys of the material made in Example 4. The barrier layer was placed on the patterned base sheet by using a small paint brush. The barrier layer was painted as thin as possible to the valleys of the base sheet. The barrier layer coating was cured for approximately 10 minutes at about 150 ° C. Visually, the amount of barrier layer present in this example appeared to be very similar in thickness of the barrier layer of Example 1. The sample was placed in a weatherometer and was tested for color change after accelerated aging. The results of the tests are set forth in Table 4.

TABLE 4

| | Accelerated Weathering Results (Color Shifts) | | | | | | |
|---|---|---|---|---|---|---|---|
| | Color Coordinates | | | | Delta E* | | |
| Example | No. Hours | L* | a* | b* | 500 HRS | 1000 HRS | 2000 HRS |
| 1 | 0 | 37.01 | 53.28 | 21.62 | 5.39 | 7.68 | 16.39 |
| 1 | 2000 | 44.20 | 39.92 | 14.68 | | | |
| 2 | 0 | 37.84 | 56.28 | 30.25 | 7.97 | 21.11 | 44.07 |
| 2 | 2000 | 58.52 | 26.28 | 3.52 | | | |
| 3* | 0 | 39.65 | 55.13 | 32.97 | 27.00 | 50.81 | 65.27 |
| 3* | 2000 | 73.13 | 10.98 | −1.16 | | | |
| 4* | 0 | 40.19 | 50.88 | 27.59 | 28.1 | 39.02 | 41.59 |
| 4* | 1000 | 57.29 | 25.89 | 2.96 | | | |
| 5 | 0 | 37.39 | 51.54 | 25.66 | 1.24 | 7.50 | 24.83 |
| 5 | 1000 | 38.60 | 46.64 | 20.11 | | | |

*Comparative Sample

The data set forth in Table 4 demonstrates the stability of the samples that possess barrier layers in accordance with the present invention. As shown by the lower Delta E* values, less color change caused by chalking was noticed in the samples of the invention. Samples 1 and 5 (where the barrier layer was pigmented to match the color of the base sheet) provided the least color change after being exposed to accelerated aging.

This invention may take on various modifications and alterations without departing from the spirit and scope thereof. Accordingly, it is to be understood that this invention is not to be limited to the above-described, but is to be controlled by the limitations set forth in the following claims and any equivalents thereof.

What is claimed is:

1. A pavement marking, which comprises:

(a) a base sheet having first and second major surfaces, the first major surface having a plurality of protuberances located thereon, the protuberances being separated by valleys, and the base sheet being comprised of a rubber and fillers;

(b) a barrier layer suitable for preventing chalking of the base sheet disposed on the first major surface of the base sheet at least in the valleys;

(c) a layer of bonding material disposed selectively on the protuberances so as to be substantially absent from the valleys; and (d) a plurality of optical elements secured to the protuberances of the base sheet by the bonding material.

2. The pavement marking of claim 1, wherein the barrier layer is disposed over the protuberances to form a substantially continuous layer on the first major surface of the base sheet.

3. The pavement marking of claim 2, wherein the barrier layer is 50 to 100 micrometers thick.

4. The pavement marking of claim 2, wherein the barrier layer is a layer of polyurethane.

5. The pavement marking of claim 4, wherein the polyurethane is an aliphatic polyurethane.

6. The pavement marking of claim 4, wherein the polyurethane barrier layer is formed by reacting two equivalents of methylene bis (4-cyclohexyl isocyanate) with one equivalent of a polycaprolactone triol polymer.

7. The pavement marking of claim 2, wherein the barrier layer is selected from the group consisting of polyurethanes, epoxies, acrylics, acrylated or methacrylated oligomers, urea-formaldehyde and melamine-formaldehyde based crosslinking systems, polyesters, polyaziridine/carboxylic acid systems, and combinations thereof.

8. The pavement marking of claim 1, wherein the optical elements, the skid-preventative particles, or the combination thereof are substantially absent from the valleys on the first major surface of the base sheet.

9. The pavement marking of claim 1, wherein the fillers include talc, mica, white pigments, silicates, glass beads, calcium carbonate, carbon black, asbestos, barytes, blanc fixe, slate flour, soft clays, or combinations thereof and are added to the base sheet at about 50 to 80 weight percent.

10. The pavement marking of claim 1, wherein the base sheet contains colored pigments.

11. The pavement marking of claim 10, wherein the colored pigments are selected from the group consisting of:

Pigment Yellow 83, 109, 110, 120, 173, 183, 191,

Pigment Red 101,170,

Pigment Orange 36,

Pigment Violet 19,

Pigment Green 7, 36,

Pigment Blue 15, carbon black, and combinations thereof.

12. The pavement marking of claim 11, wherein the colored pigments are added to the base sheet at about 1 to 10 percent based on the weight of the base sheet.

13. The pavement marking of claim 1, wherein the barrier layer prevents the base sheet from becoming substantially oxidized by exposure to UV light.

14. The pavement marking of claim 1, wherein the barrier layer is a thermoset polymer.

15. The pavement marking of claim 1, wherein the barrier layer includes pigments, UV stabilizers, or combinations thereof.

16. The pavement marking of claim 15, wherein the UV stabilizers are selected from the group consisting of UV absorbers, hindered amines, nickel chelates, hindered phenols, aryl esters, and combinations thereof.

17. The pavement marking of claim 15, wherein colored pigments that match the color of the base sheet are added to the barrier layer.

18. The pavement marking of claim 17, wherein the colored pigments are selected from the group consisting of:

Pigment Yellow 83, 109, 110, 120, 173, 183, 191,

Pigment Red 101,170,

Pigment Orange 36,

Pigment Violet 19,

Pigment Green 7, 36,

Pigment Blue 15, carbon black, and combinations thereof.

19. The pavement marking of claim 17, wherein the pigments are present in the barrier layer at 1 to 40 percent based on the weight of the barrier layer.

20. The pavement marking of claim 1, wherein the bonding material is an aliphatic thermoset polyurethane.

21. The pavement marking of claim 1, wherein the bonding material contains UV stabilizers, colored pigments, or a combination thereof.

22. The pavement marking of claim 21, wherein the bonding material is colored to match the color of the base sheet, barrier layer, or combination thereof.

23. A method of making a patterned pavement marking, which comprises:

(a) providing a base sheet that contains rubber and fillers, the base sheet having a first major surface that has protuberances disposed thereon which are separated by valleys;

(b) forming a barrier layer suitable for preventing chalking of the base sheet at least on the valleys of the base sheet;

(c) applying a bonding material selectively to the protuberances so as to be substantially absent from the valleys; and (d) embedding optical elements in the bonding material.

24. A pavement marking, which comprises:

(a) a base sheet having first and second major surfaces, the first major surface having a plurality of protuberances located thereon, the protuberances being separated by valleys, and the base sheet being comprised of a robber and fillers;

(b) a barrier layer suitable for preventing chalking of the base sheet disposed on the first major surface of the base sheet in the valleys and over the protuberances, the barrier layer containing UV stabilizers, colored pigments, or a combination thereof, (c) a layer of bonding material disposed selectively on the protuberances so as to be substantially absent from the valleys; and (d) a plurality of optical elements secured to the protuberances of the base sheet by the bonding material and being substantially absent from the valleys.

25. A pavement marking, which comprises:

(a) a base sheet having first and second major surfaces, the first major surface having a plurality of protuberances located thereon, the protuberances being separated by valleys, and the base sheet being comprised of a rubber and fillers;

(b) a barrier layer suitable for preventing chalking of the base sheet disposed on the first major surface of the base sheet at least in the valleys;

(c) a layer of bonding material disposed selectively on the protuberances so as to be substantially absent from the valleys; and (d) a plurality of skid preventative particles secured to the protuberances of the base sheet by the bonding material.

26. A method of making a patterned pavement marking, which comprises:

(a) providing a base sheet that contains rubber and fillers, the base sheet having a first major surface that has protuberances disposed thereon which are separated by valleys;

(b) forming a barrier layer suitable for preventing chalking of the base sheet at least on the valleys of the base sheet;

(c) applying a bonding material selectively to the protuberances so as to be substantially absent from the valleys; and (d) embedding skid-preventative particles in the bonding material.

27. A pavement marking, which comprises:

(a) a base sheet having first and second major surfaces, the first major surface having a plurality of protuberances located thereon, the protuberances being separated by valleys, and the base sheet being comprised of a rubber and fillers;

(b) a barrier layer suitable for preventing chalking of the base sheet disposed on the first major surface of the base sheet in the valleys and over the protuberances, the barrier layer containing UV stabilizers, colored pigments, or a combination thereof;

(c) a layer of bonding material disposed selectively on the protuberances so as to be substantially absent from the valleys; and (d) a plurality of skid-preventative particles secured to the protuberances of the base sheet by the bonding material and being substantially absent from the valleys.

* * * * *

UNITED STATES PATENT AND TRADEMARK OFFICE

CERTIFICATE OF CORRECTION

PATENT NO.: 5,593,246

DATED: January 14, 1997

INVENTOR(S): Thomas P. Hedblom et al.

It is certified that error appears in the above-identified patent and that said Letters Patent is hereby corrected as shown below:

Col. 3, line 63, "2" should read -- 12 --.

Col. 4, line 28, "acrylonitfile-" should read -- acrylonitrile- --.

Col. 12, line 2, "carded" should read -- carried --.

Col. 14, line 45, "robber" should read -- rubber --.

Signed and Sealed this

Fifteenth Day of April, 1997

Bruce Lehman

*Attest:*

BRUCE LEHMAN

*Attesting Officer*

*Commissioner of Patents and Trademarks*